US006975272B2

(12) United States Patent
Yuanzhu

(10) Patent No.: US 6,975,272 B2
(45) Date of Patent: Dec. 13, 2005

(54) CIRCULARLY POLARIZED WAVE ANTENNA DEVICE SUITABLE FOR MINIATURIZATION

(75) Inventor: Dou Yuanzhu, Fukushima-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 0 days.

(21) Appl. No.: 10/994,955

(22) Filed: Nov. 22, 2004

(65) Prior Publication Data

US 2005/0116863 A1 Jun. 2, 2005

(30) Foreign Application Priority Data

Nov. 27, 2003 (JP) ..... 2003-397295

(51) Int. Cl.[7] ..... H01Q 1/38
(52) U.S. Cl. ..... 343/700 MS; 343/846
(58) Field of Search ..... 343/700 MS, 846, 343/848, 713; H01Q 1/38

(56) References Cited

U.S. PATENT DOCUMENTS 5,181,044 A * 1/1993 Matsumoto et al. ..... 343/752
5,864,318 A * 1/1999 Cosenza et al. ..... 343/700 MS
6,049,314 A * 4/2000 Munson et al. ..... 343/846
6,133,883 A * 10/2000 Munson et al. ..... 343/700 MS
6,456,249 B1 * 9/2002 Johnson et al. ..... 343/702

FOREIGN PATENT DOCUMENTS

JP 7-297626 11/1995
JP 2002-237714 8/2002

* cited by examiner

*Primary Examiner*—Hoanganh Le
(74) *Attorney, Agent, or Firm*—Brinks Hofer Gilson & Lione

(57) ABSTRACT

A circularly polarized wave antenna device contains a dielectric substrate provided on a ground conductor 1, electrodes provided on the dielectric substrate to face the ground conductor. The electrodes form capacitors together with the ground conductor. A radiating conductor plate is made of a metal plate. Leg pieces are bent toward the dielectric substrate side at a plurality of locations on the radiating conductor plate. Two electric lengths on the radiating conductor plate that are generated in the directions passing the center of the radiating conductor plate and orthogonal to each other are equal to each other. Areas of the electrodes to which two leg pieces provided on a first line S3 are connected are different from those of the electrodes to which two leg pieces provided on a second line S4 are connected.

6 Claims, 12 Drawing Sheets

CIRCULARLY POLARIZED WAVE ANTENNA DEVICE SUITABLE FOR MINIATURIZATION

This application claims the benefit of priority to Japanese Patent Application No. 2003-397295 filed on Nov. 27, 2003, herein incorporated by reference.

BACKGROUND OF THE INVENTION

1. Field of the Invention

The present invention relates to a patch type of circularly polarized wave antenna device that is suitable for a GPS antenna or the like.

2. Description of the Related Art

FIG. 24 is a perspective view of a conventional circularly polarized wave antenna device. A configuration of the conventional circularly polarized wave antenna device will be described with reference to FIG. 24. A patterned ground conductor 52 is provided on a bottom surface of a thick dielectric substrate 51 made of an insulating material, and a patterned radiating conductor 53 is provided on a top surface of the dielectric substrate 51.

Further, the radiating conductor 53 is formed substantially in a square shape and has a feeding portion 54 protruding from one side thereof. In addition, circularly polarized cut portions 53*a* are respectively provided in two corner portions opposite to each other. In this manner, the conventional circularly polarized wave antenna device is formed (for example, see Japanese Unexamined Patent Application Publication No. 2002-237714).

However, in the conventional circularly polarized wave antenna device, the antenna efficiency is lowered due to the dielectric loss caused by the dielectric substrate 51. In addition, since the radiating conductor 53 has a rectangular shape, the overall size of the antenna device increases. As a result, it is difficult to realize a small-size antenna device.

SUMMARY OF THE INVENTION

Accordingly, the present invention has been made to solve the above-mentioned problems, and it is an object of the present invention to provide a circularly polarized wave antenna device having a small-sized radiating conductor plate, a low dielectric loss, and excellent performance.

In order to achieve the above-mentioned object, according to a first aspect of the present invention, there is provided a circularly polarized wave antenna device comprising: a dielectric substrate provided on a ground conductor; a plurality of electrodes provided on the dielectric substrate to face the ground conductor, the plurality of electrodes forming capacitors together with the ground conductor; a radiating conductor plate made of a metal plate and arranged above the dielectric substrate at a predetermined gap; and a plurality of leg pieces bent toward the dielectric substrate side at a plurality of locations on the radiating conductor plate. In the antenna device, two electrical lengths on the radiating conductor plate that are generated in the directions passing the center of the radiating conductor plate and being orthogonal to each other are equal to each other, and the leg pieces are four in which two leg pieces are provided on each of first and second lines that pass the center of the radiating conduct plate and are orthogonal to each other at locations except a central portion of the radiating conductor plate. In addition, the leg pieces are connected to the electrodes, respectively, and areas of the electrodes to which the two leg pieces provided on the first line are connected are different from those of the electrodes to which the two leg pieces provided on the second line are connected.

Further, according to a second aspect of the present invention, the ground conductor is formed of a ground conductor plate made of a metal plate larger than the radiating conductor plate.

Furthermore, according to a third aspect of the present invention, the four leg pieces are provided at locations separated from the center of the radiating conductor plate by the same distance.

Further, according to a fourth aspect of the present invention, the radiating conductor plate is formed in an octagonal shape and has a pair of first opposing sides and a pair of second opposing sides respectively located on the first and second lines, and the leg pieces are provided at locations between the first and second opposing sides on the first and second lines, except the central portion of the radiating conductor plate.

Furthermore, according to a fifth aspect of the present invention, the leg pieces are provided along the first and second opposing sides.

Further, according to a sixth aspect of the present invention, the leg pieces are provided at locations closer to the central portion of the radiating conductor plate than to the first and second opposing sides.

As described above, a circularly polarized wave antenna device of the present invention comprises a dielectric substrate provided on a ground conductor; a plurality of electrodes provided on the dielectric substrate to face the ground conductor, the plurality of electrodes forming capacitors together with the ground conductor; a radiating conductor plate made of a metal plate and arranged above the dielectric substrate at a predetermined gap; and a plurality of leg pieces bent toward the dielectric substrate side at a plurality of locations on the radiating conductor plate. In the antenna device, two electrical lengths on the radiating conductor plate that are generated in the directions passing the center of the radiating conductor plate and being orthogonal to each other are equal to each other, and the leg pieces are four in which two leg pieces are provided on each of first and second lines that pass the center of the radiating conduct plate and are orthogonal to each other at locations except a central portion of the radiating conductor plate. In addition, the leg pieces are connected to the electrodes, respectively, and areas of the electrodes to which the two leg pieces provided on the first line are connected are different from those of the electrodes to which the two leg pieces provided on the second line are connected. in this manner, since the capacitors are formed by the electrodes and the ground conductor, a resonance frequency decreases. Therefore, it is possible to achieve a radiating conductor plate having a small size.

In addition, the difference between two electrical lengths occurs by changing the areas of the electrodes, so that a circularly polarized wave is obtained. Therefore, it is possible to achieve a circularly polarized wave antenna device with a simple structure and high productivity.

In addition, since the dielectric substrate may be composed of a thin plate similar to the circuit board, it is possible to greatly suppress the influence of the dielectric loss, thereby achieving a circularly polarized antenna having excellent performance. In addition, the installation of the radiating conductor plate and the connection of the radiating conductor plate to the electrodes can be carried out only by soldering the leg pieces to the electrodes. Therefore, it is possible to achieve a circularly polarized wave antenna device having a low manufacturing cost and high productivity.

Furthermore, since the ground conductor is formed of a ground conductor plate made of a metal plate larger than the radiating conductor plate, the ground conductor plate can be composed of an inexpensive metal plate, such as an iron plate. Therefore, it is possible to achieve a circularly polarized wave antenna device having a low manufacturing cost.

Further, since the tour leg pieces are provided at locations separated from the center of the radiating conductor plate by the same distance, distances from the center of the radiating conductor plate to front ends of the leg pieces are equal to each other. Therefore, electric characteristics can be stabilized.

In addition, the radiating conductor plate is formed in an octagonal shape and has a pair of first opposing sides and a pair of second opposing sides respectively located on the first and second lines, and the leg pieces are provided at locations between the central portion of the radiating conductor plate and the first and second opposing sides on the first and second lines, except the central portion of the radiating conductor plate. Therefore, the size of the radiating conductor plate can decrease, and the installation of the leg pieces can be stabilized in view of the installation locations.

Further, since the leg pieces are provided along the first and second opposing sides, a radiating conductor plate having a larger area can be obtained.

Further, since the leg pieces are provided at locations closer to the central portion of the radiating conductor plate than to the first and second opposing sides, the leg pieces composed of bent pieces can be formed by bending the outer circumference of the radiating conductor plate. Therefore, it is possible to achieve a circularly polarized wave antenna device having a low material cost and a low manufacturing cost.

DESCRIPTION OF THE PREFERRED EMBODIMENTS

Figure 1:
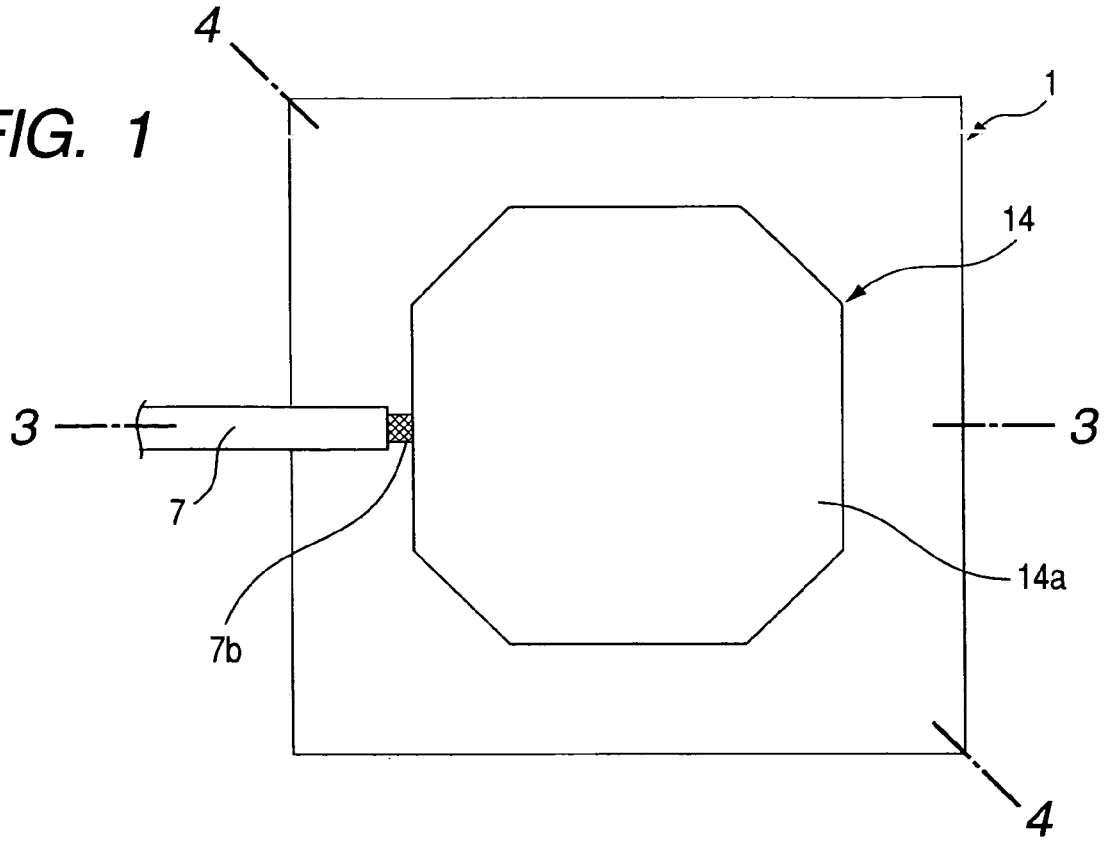
FIG. 1 is a plan view of a circularly polarized wave antenna device according to a first embodiment of the present invention.
Figure 2:
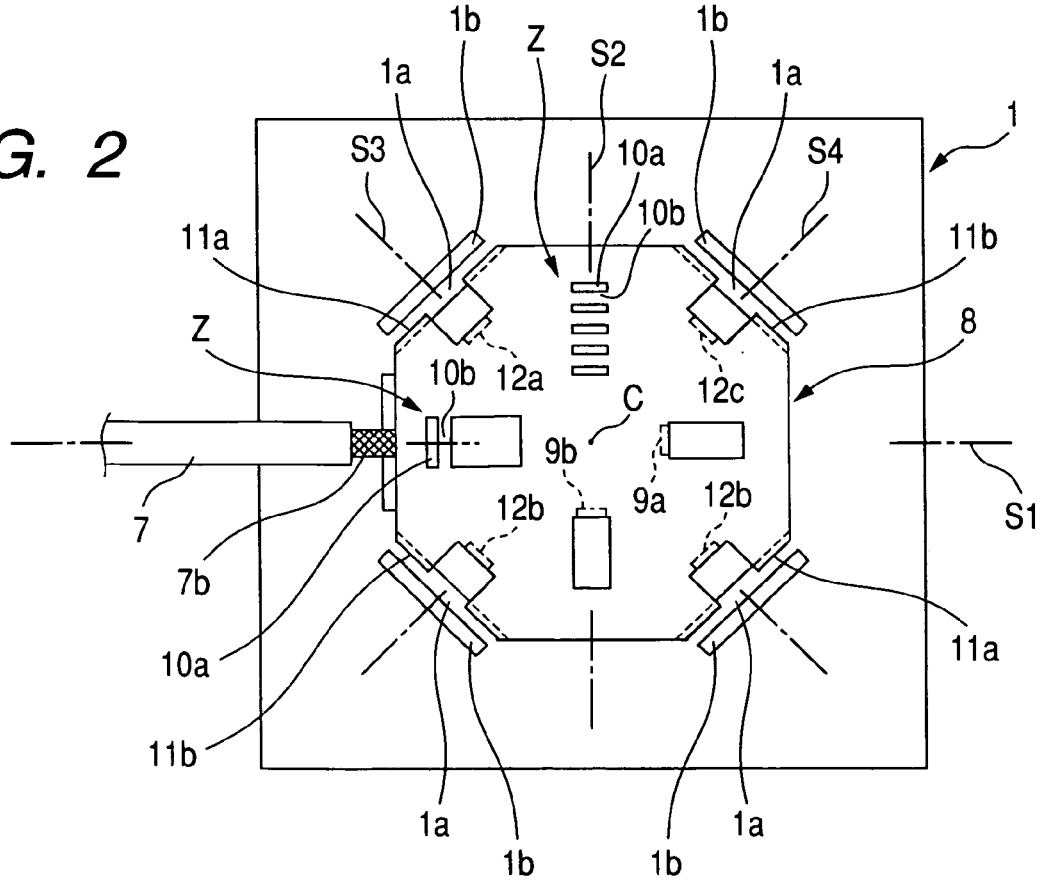
FIG. 2 is a plan view of the circularly polarized wave antenna device according to the first embodiment of the present invention in a state in which a cover is removed from the circularly polarized wave antenna device.
Figure 3:
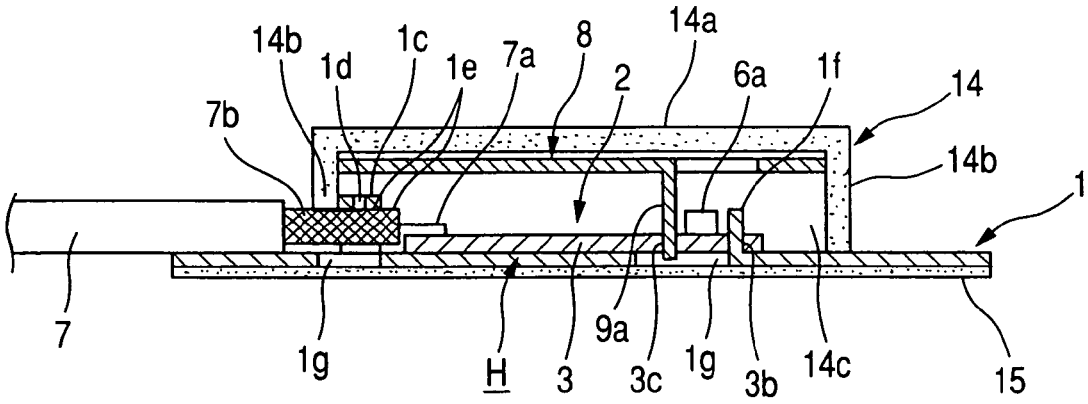
FIG. 3 is a sectional view taken along the line 3—3 of FIG. 1.
Figure 4:
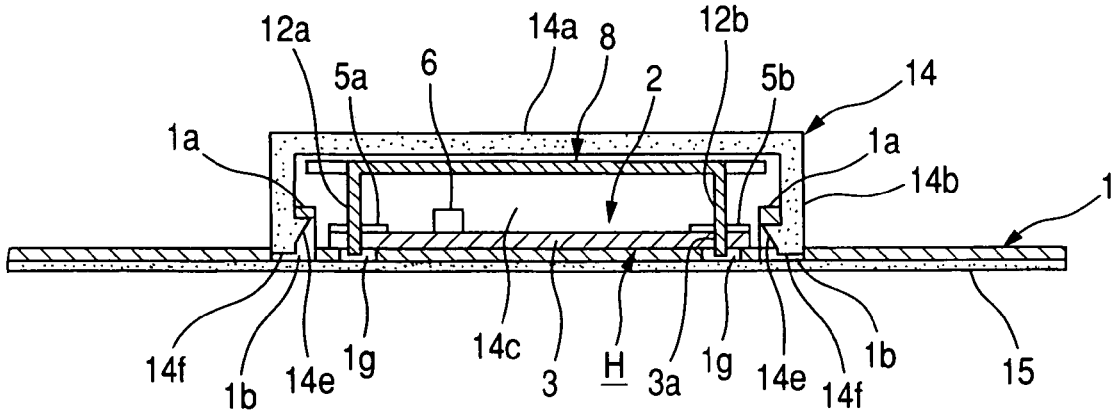
FIG. 4 is a sectional view taken along the line 4—4 of FIG. 1.
Figure 5:
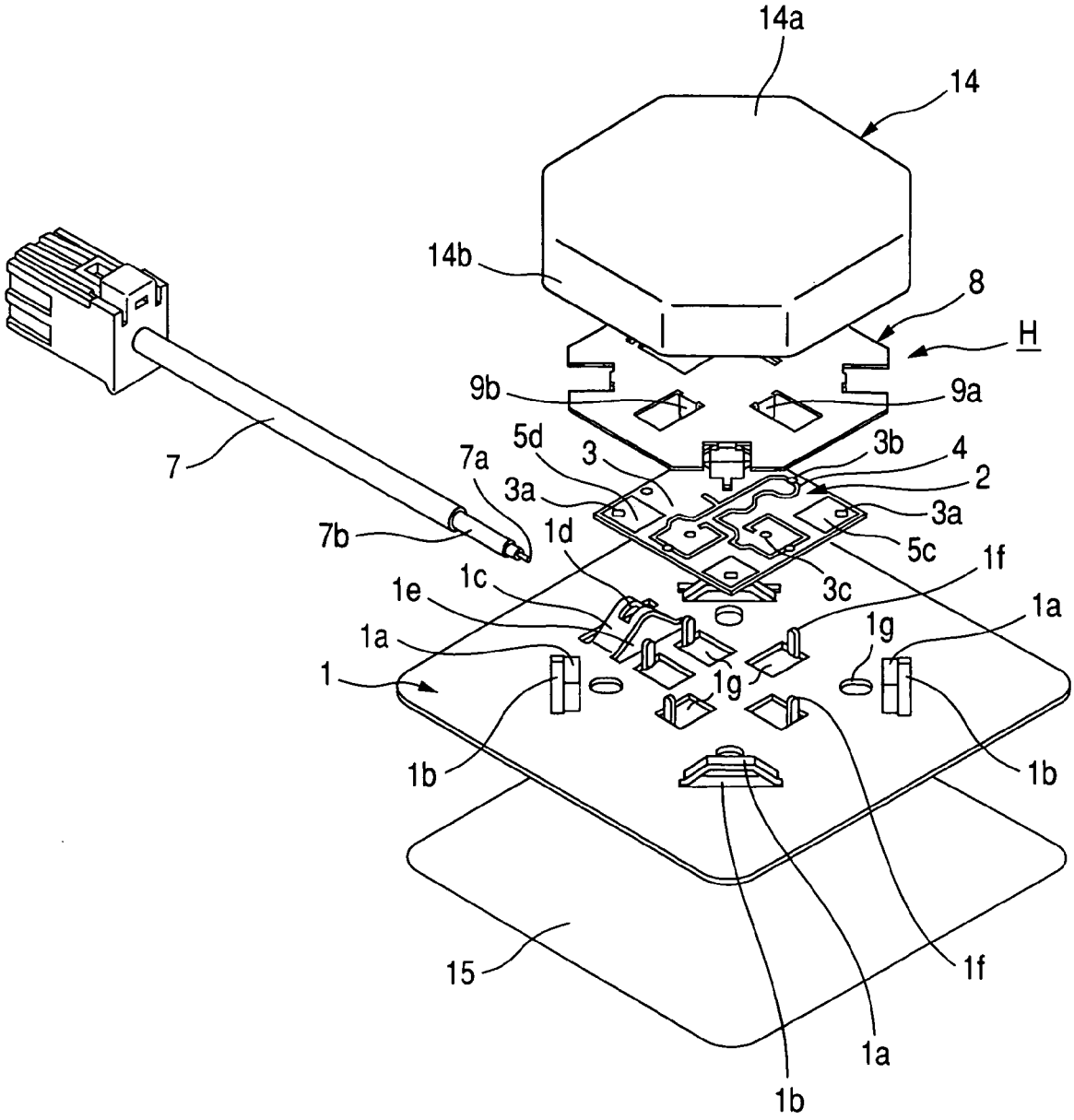
FIG. 5 is an exploded perspective view of the circularly polarized wave antenna device according to the first embodiment of the present invention.

A circularly polarized wave antenna device of the present invention will now be described with reference to the accompanying drawings. FIG. 1 is a plan view of a circularly polarized wave antenna device according to a first embodiment of the present invention; FIG. 2 is a plan view of the circularly polarized wave antenna device according to the first embodiment of the present invention in a state in which a cover is removed from the circularly polarized wave antenna device; FIG. 3 is a sectional view taken along the line 3—3 of FIG. 1; FIG. 4 is a sectional view taken along the line 4—4 of FIG. 1; and FIG. 5 is an exploded perspective view of the circularly polarized wave antenna device according to the first embodiment of the present invention.

Figure 6:
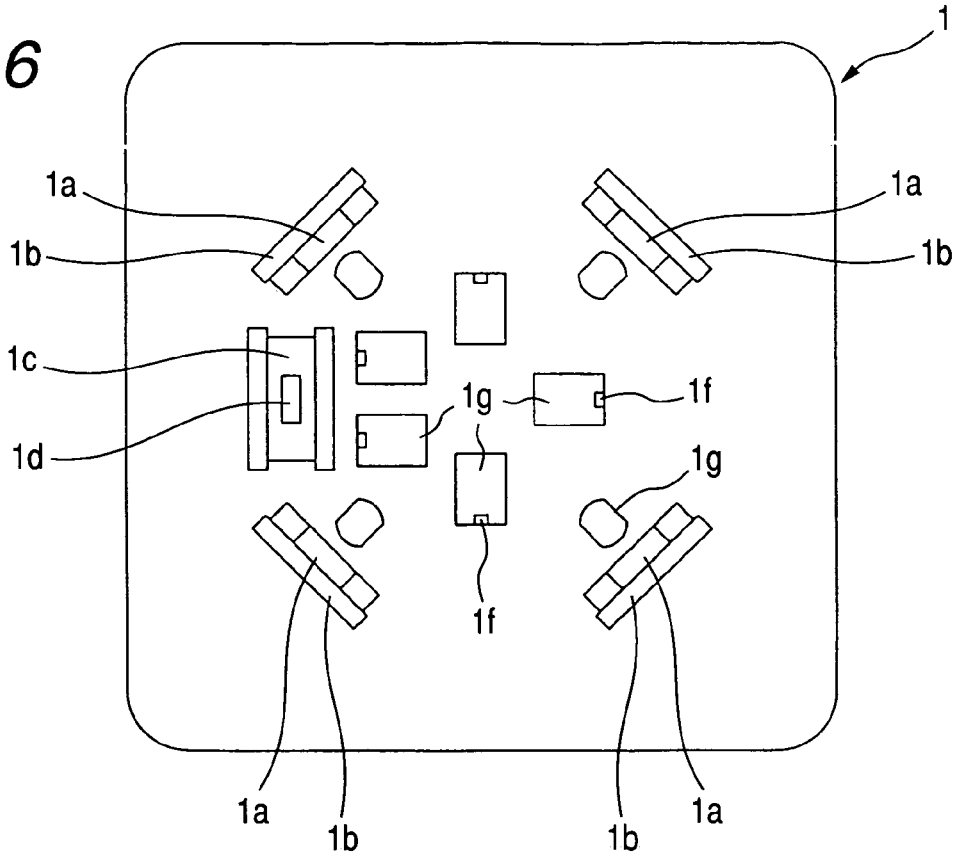
FIG. 6 is a plan view of a ground conductor plate of the circularly polarized wave antenna device according to the first embodiment of the present invention.
Figure 7:
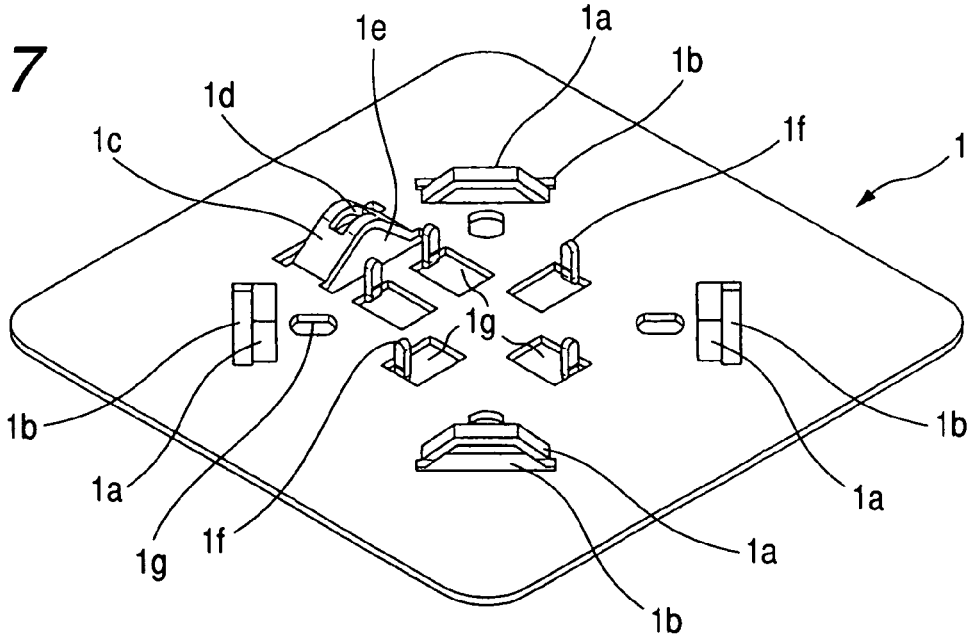
FIG. 7 is a perspective view of the ground conductor plate of the circularly polarized wave antenna device according to the first embodiment of the present invention.
Figure 8:
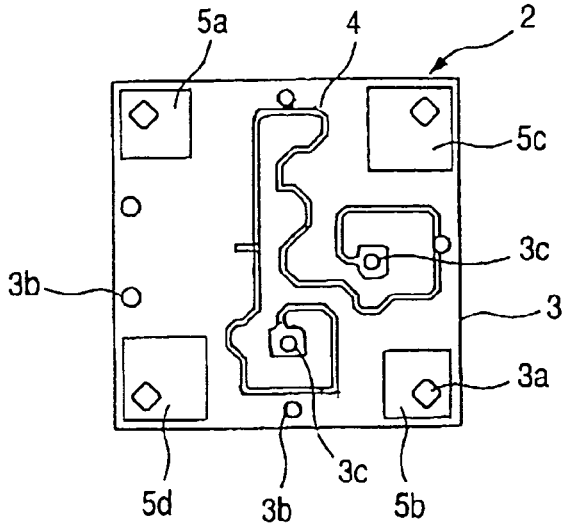
FIG. 8 is a plan view of a circuit board of the circularly polarized wave antenna device according to the first embodiment of the present invention.
Figure 9:
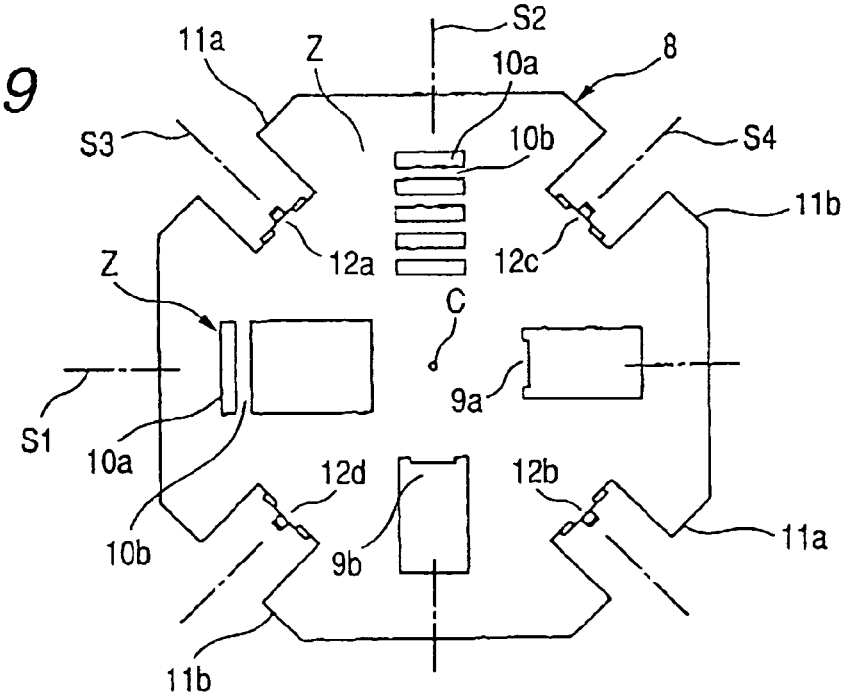
FIG. 9 is a plan view of a radiating conductor plate of the circularly polarized wave antenna device according to the first embodiment of the present invention.
Figure 10:
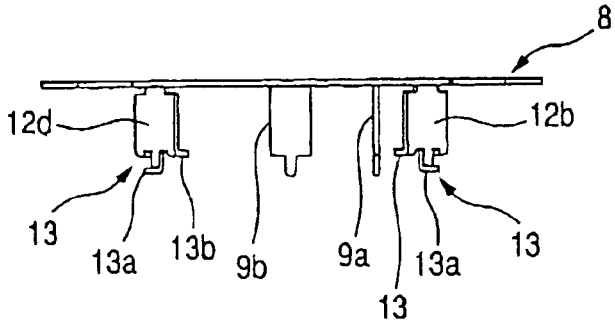
FIG. 10 is a front view of the radiating conductor plate of the circularly polarized wave antenna device according to the first embodiment of the present invention.
Figure 11:
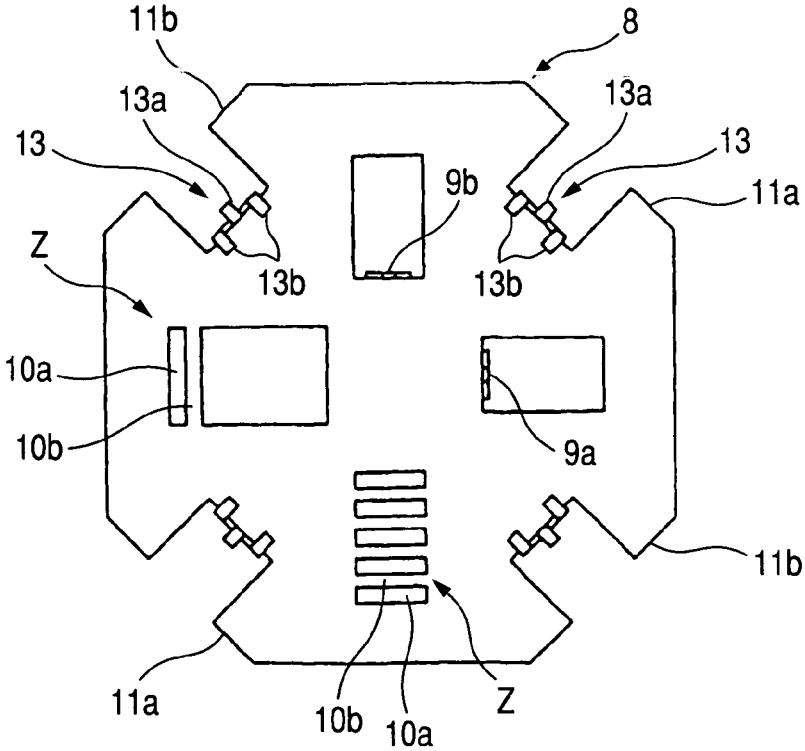
FIG. 11 is a bottom view of the radiating conductor plate of the circularly polarized wave antenna device according to the first embodiment of the present invention.

Further, FIG. 6 is a plan view of a ground conductor plate of the circularly polarized wave antenna device according to the first embodiment of the present invention; FIG. 7 is a perspective view of the ground conductor plate of the circularly polarized wave antenna device according to the first embodiment of the present invention; FIG. 8 is a plan view of a circuit board of the circularly polarized wave antenna device according to the first embodiment of the present invention; FIG. 9 is a plan view of a radiating conductor plate of the circularly polarized wave antenna device according to the first embodiment of the present invention; FIG. 10 is a front view of the radiating conductor plate of the circularly polarized wave antenna device according to the first embodiment of the present invention; and FIG. 11 is a bottom view of the radiating conductor plate of the circularly polarized wave antenna device according to the first embodiment of the present invention.

Figure 12:
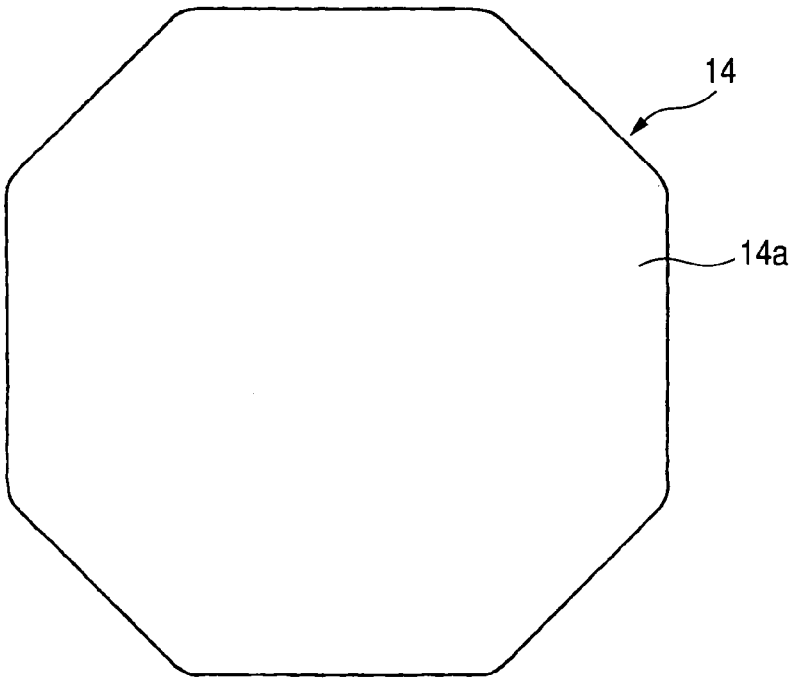
FIG. 12 is a plan view of the cover of the circularly polarized wave antenna device according to the first embodiment of the present invention.
Figure 13:
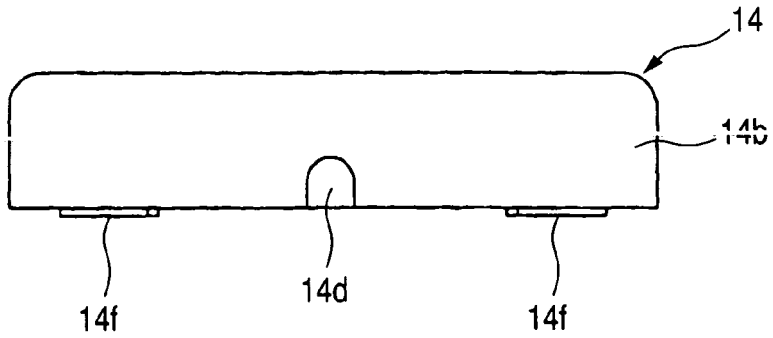
FIG. 13 is a left side view of the cover of the circularly polarized wave antenna device according to the first embodiment of the present invention.
Figure 14:
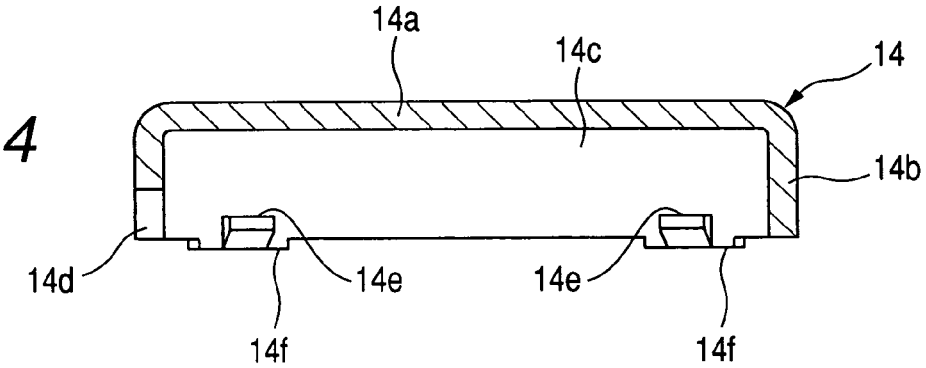
FIG. 14 is a sectional view of essential elements of the cover of the circularly polarized wave antenna device according to the first embodiment of the present invention.
Figure 15:
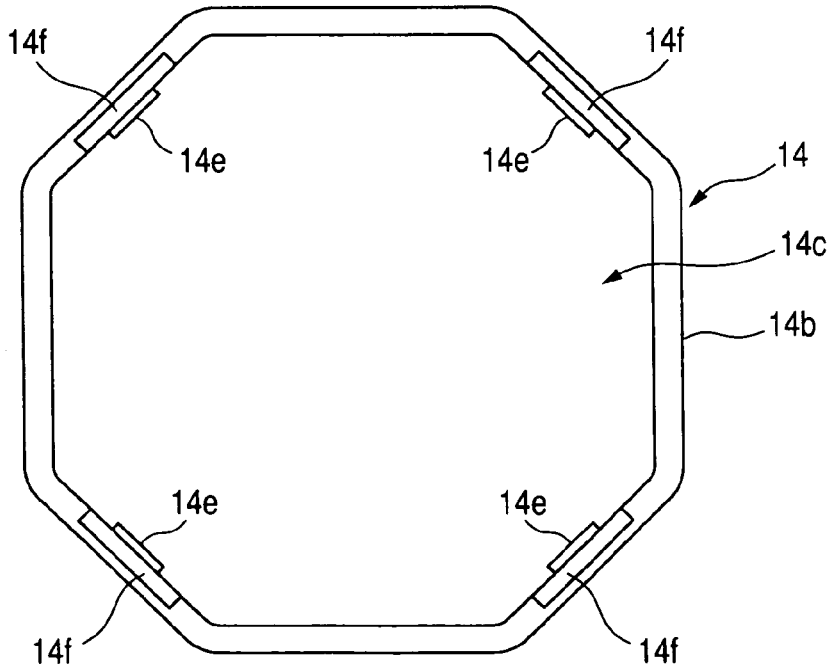
FIG. 15 is a bottom view of the cover of the circularly polarized wave antenna device according to the first embodiment of the present invention.

Further, FIG. 12 is a plan view of the cover of the circularly polarized wave antenna device according to the first embodiment of the present invention; FIG. 13 is a left side view of the cover of the circularly polarized wave antenna device according to the first embodiment of the present invention; FIG. 14 is a sectional view of essential elements of the cover of the circularly polarized wave antenna device according to the first embodiment of the present invention; and FIG. 15 is a bottom view of the cover of the circularly polarized wave antenna device according to the first embodiment of the present invention.

Figure 16:
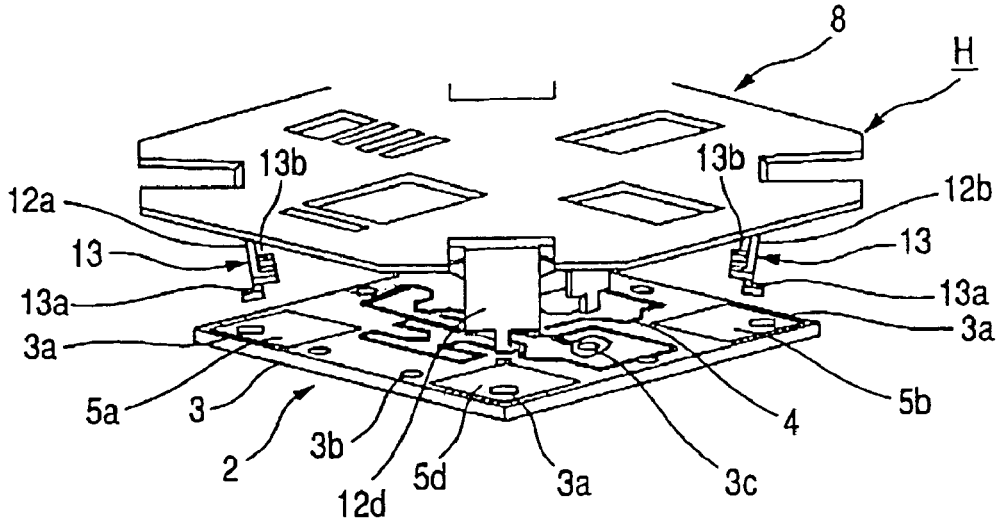
FIG. 16 is an explanatory view showing a first step of a method of mounting the radiating conductor plate on the circuit board in the circularly polarized wave antenna device according to the first embodiment of the present invention.
Figure 17:
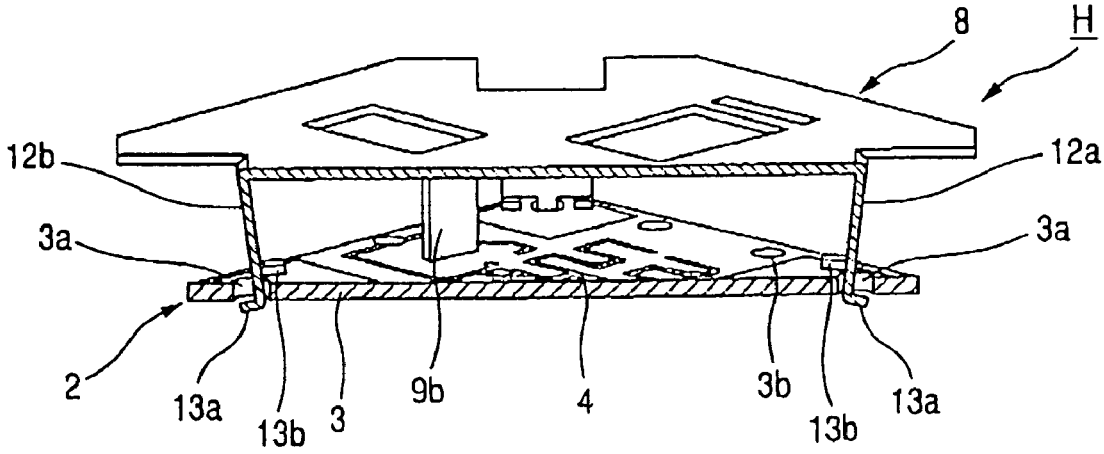
FIG. 17 is an explanatory view showing a second step of the method of mounting the radiating conductor plate on the circuit board in the circularly polarized wave antenna device according to the first embodiment of the present invention.
Figure 18:
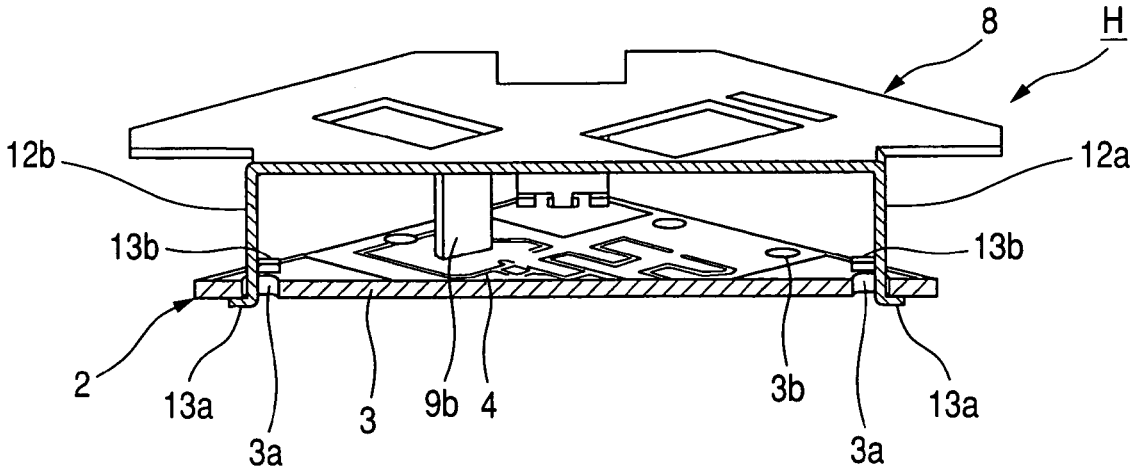
FIG. 18 is an explanatory view showing a third step of the method of mounting the radiating conductor plate on the circuit board in the circularly polarized wave antenna device according to the first embodiment of the present invention.
Figure 19:
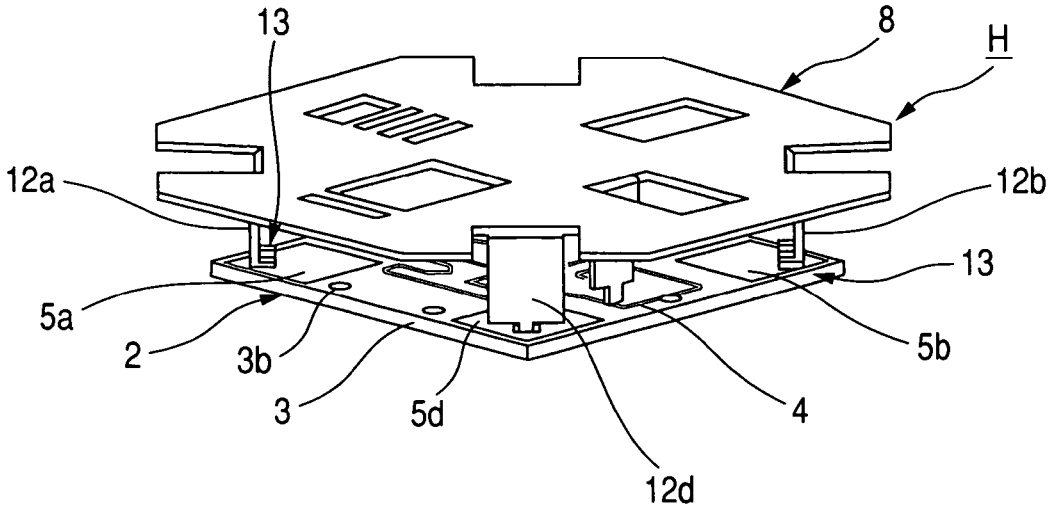
FIG. 19 is an explanatory view showing a state in which the steps of the method of mounting the radiating conductor plate on the circuit board is completed in the circularly polarized wave antenna device according to the first embodiment of the present invention.

Furthermore, FIG. 16 is an explanatory view showing a first step of a method of mounting the radiating conductor plate on the circuit board in the circularly polarized wave antenna device according to the first embodiment of the present invention; FIG. 17 is an explanatory view showing a second step of the method of mounting the radiating conductor plate on the circuit board in the circularly polarized wave antenna device according to the first embodiment of the present invention; FIG. 18 is an explanatory view showing a third step of the method of mounting the radiating conductor plate on the circuit board in the circularly polarized wave antenna device according to the first embodiment of the present invention; and FIG. 19 is a perspective view showing a state in which the steps of mounting the radiating conductor plate on the circuit board are completed in the circularly polarized wave antenna device according to the first embodiment of the present invention.

Figure 20:
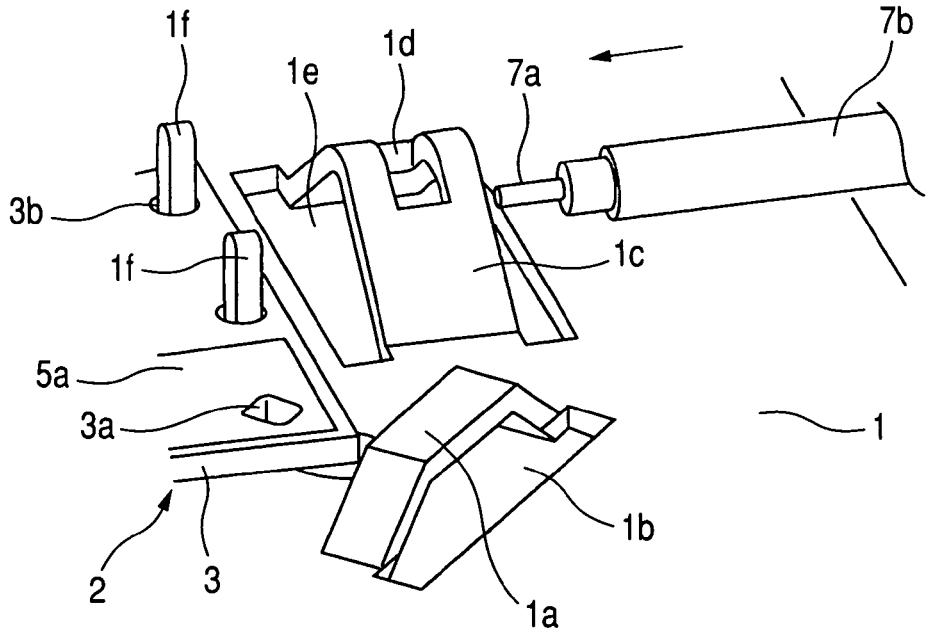
FIG. 20 is an explanatory view showing a method of mounting a cable on the ground conductor plate in the circularly polarized wave antenna device according to the first embodiment of the present invention.
Figure 21:
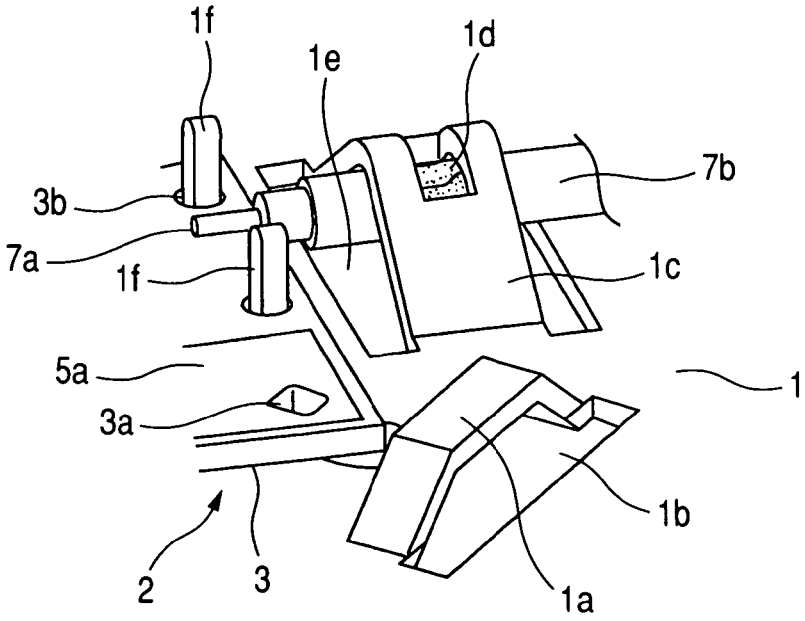
FIG. 21 is a perspective view showing a state in which a step of mounting the cable on the ground conductor plate is completed in the circularly polarized wave antenna device according to the first embodiment of the present invention.

Furthermore, FIG. 20 is an explanatory view showing a method of mounting a cable on the ground conductor plate in the circularly polarized wave antenna device according to the first embodiment of the present invention; and FIG. 21 is a perspective view showing a state in which mounting the cable on the ground conductor plate is completed in the circularly polarized wave antenna device according to the first embodiment of the present invention.

Figure 22:
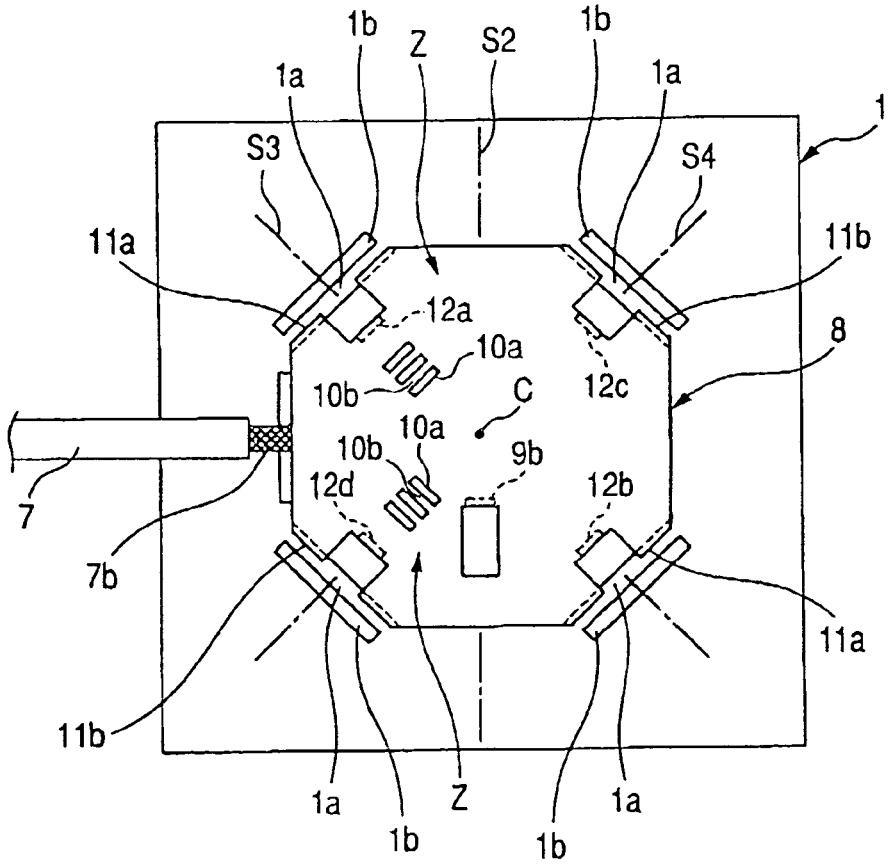
FIG. 22 is a plan view of a circularly polarized wave antenna device according to a second embodiment of the present invention in a state in which a cover is removed from the circularly polarized wave antenna device.
Figure 23:
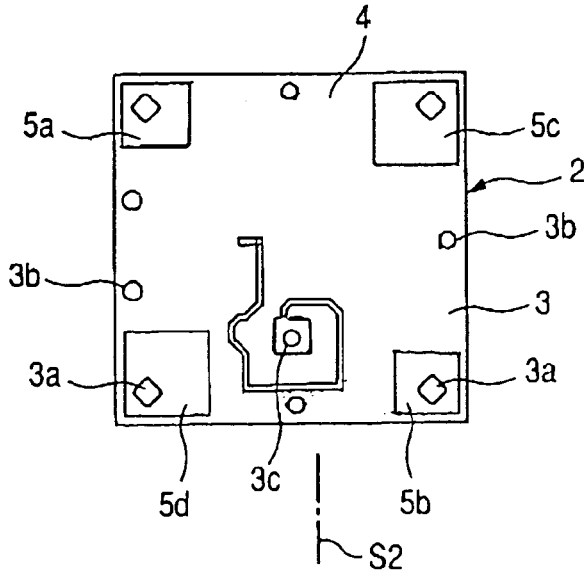
FIG. 23 is a plan view of a circuit board of the circularly polarized wave antenna device according to the second embodiment of the present invention.
Figure 24:
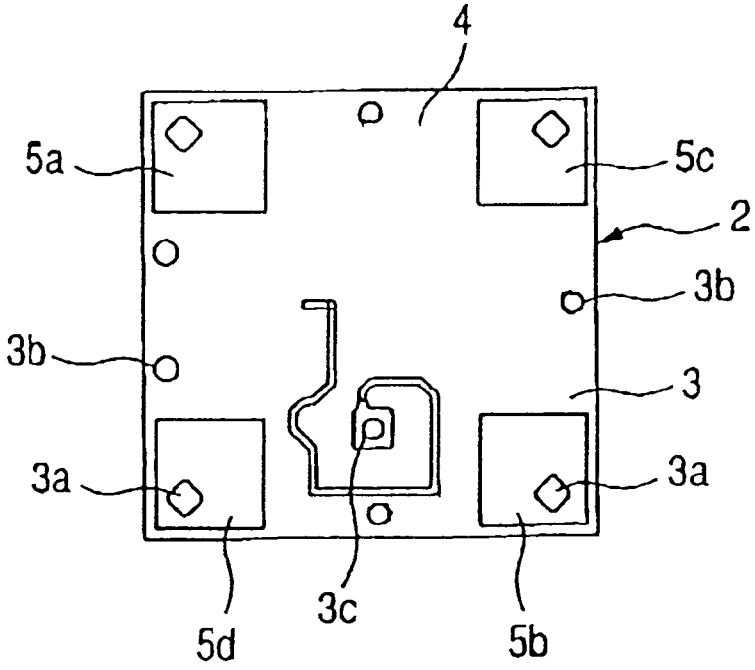
FIG. 24 is a perspective view of a conventional circularly polarized wave antenna device.

Furthermore, FIG. 22 is a plan view of a circularly polarized wave antenna device according to a second embodiment of the present invention in a state in which a cover is removed from the circularly polarized wave antenna device; FIG. 23 is a plan view of a circuit board of the circularly and polarized wave antenna device according to the second embodiment of the present invention.

Next, the configuration of the circularly polarized wave antenna device according to the first embodiment of the present invention will be described with reference to FIGS. 1 to 21. A ground conductor plate 1, serving as a ground conductor, is composed of a metal plate. The ground conductor plate 1 comprises a plurality of hooking portions 1*a* that is cut and erected upward in an arch shape and holes 1*b* provided in the vicinities of the hooking portions 1*a*, which are provided at locations in all directions, and a plurality of stopper portions 1*c* that is cut and erected upward in an arch shape, cut-out portions 1*d* each composed of a through hole provided in the vicinity of a top portion of the stopper portion 1*c*, and inserting portions 1*e* each provided in a bottom portion of the stopping portion 1*c*, which are provided between two hooking portions 1*a*, as shown particularly in FIGS. 6 and 7.

In addition, the ground conductor plate 1 has a plurality of bent pieces if bent toward the upper side of the ground conductor plate 1 and release holes 1*g* formed at a plurality of positions including the vicinities of the bent pieces 1*f*.

As shown particularly in FIG. 8, a circuit board 2 having a rectangular shape comprises a dielectric substrate 3 composed of an insulating plate, a wiring pattern 4 provided on the dielectric substrate 3, and a plurality of first, second, third, and fourth electrodes 5*a*, 5*b*, 5*c*, and 5*d* provided at four corner portions of the dielectric substrate 3.

Further, the first and second electrodes 5*a* and 5*b* that are obliquely opposite to each other have the same area, and the third and fourth electrodes 5*c* and 5*d* that are obliquely opposite to each other have the same area. However, the areas of the first and second electrodes 5*a* and 5*b* are smaller than those of the third and fourth electrodes 5*c* and 5*d*.

Furthermore, the dielectric substrate 3 comprises a plurality of penetrating portions 3*a* composed of through holes formed at the locations of the first to fourth electrodes 5*a* to 5*d*, a plurality of first holes 3*b* formed near the outer circumference of the dielectric substrate 3, and a plurality of second holes 3*c* formed at a central portion of the dielectric substrate 3.

In addition, on the circuit board 2, electronic components 6 including a short chip type of capacitor, a tall dielectric filter 6*a*, and the like are mounted, and a desired electric circuit composed of a matching circuit, a filter circuit, and an amplifying circuit is provided.

In addition, the tall electronic component 6 composed of the dielectric filter 6*a* or the like is arranged near the outer circumference of the circuit board 2.

In the circuit board 2 having the above-mentioned structure, in a state in which the bent pieces 1*f* are inserted into the first holes 3*b*, the bottom surface of the circuit board 2 is mounted on the ground conductor plate 1, the bent pieces 1*f* are soldered to the wiring pattern 4, and the circuit board 2 is supported by the bent pieces 1*f*, as shown particularly in FIGS. 3 and 5.

At this time, the bent pieces 1*f* pass through the first holes 3*b* so that front ends of the bent pieces 1*f* protrude upward, and the release holes 1*g* of the ground conductor plate 1 are located under the penetrating portions 3*a* and the second holes 3*c* of the circuit board 2. Therefore, the penetrating portion 3*a* and the second holes 3*c* escape from the ground conductor plate 1.

In addition, when the circuit board 2 is mounted on the ground conductor plate 1, the first to fourth electrodes 5*a* to 5*d* face the ground conductor plate 1 with the dielectric substrate 3 interposed therebetween to form capacitors, respectively.

A coaxial cable 7 comprises a central conductor 7*a* and a reticulated outer conductor 7*b* covering the outside of the central conductor 7*a* with an insulated covering portion interposed therebetween. When the cable 7 is installed, first, a front end of the cable 7 is inserted into the inserting portion 1*e* of the stopper portion 1*c*, as shown in FIG. 20. A state in which the installation of the cable 7 is completed is shown in FIG. 21.

In addition, in the state shown in FIG. 21, the central conductor 7*a* is soldered to the wiring pattern 4, the outer conductor 7*b* and the stopper portion 1*c* are soldered at the location of the cut-out portion 1*d*, and the cable 7 is supported by the stopper portion 1*c*.

An octagonal radiating conductor plate 8 is composed of a metal plate. The radiating conductor plate 8 comprises first and second feeding portions 9*a* and 9*b* composed of bent pieces bent toward the lower side of the radiating conductor plate 8, which are respectively provided at locations orthogonal to each other, and adjusting means Z for adjusting electrical lengths respectively provided on a line S1 passing the first feeding portion 9*a* and a center C and on a line S2 passing the second feeding portion 9*b* and the center C, as shown particularly in FIGS. 9 to 11.

Further, the direction of the electric field on the radiating conductor plate 8 is the same as the directions of the lines S1 and S2, and first and second electrical lengths are generated respectively in the directions of the lines S1 and S2.

Furthermore, the adjusting means Z are provided along the lines S1 and S2, which are the electric field directions, and are provided at locations between the central portion and the outer circumference, except for the location of the central portion of the radiating conductor plate 8.

In addition, the adjusting means Z are provided at sides opposite to the first and second feeding portions 9*a* and 9*b* centering the center C and are composed of ladder portions formed by combining holes 10*a* with crosspiece portions 10*b*. In the adjusting means, by cutting the crosspieces 10*b*, the electrical length can be adjusted so as to extend.

In addition, the radiating conductor plate 8 comprises a pair of first opposing sides 11*a* located on the line S3 and a pair of second opposing sides 11*b* located on the line S4. The lines S3 and S4 pass the center C and are orthogonal to each other, and four leg pieces 12*a*, 12*b*, 12*c*, and 12*d* are provided at the locations between the central portion of the radiating conductor plate 8 and the first and second opposing sides 11*a* and 11*b* on the lines S3 and S4, except the central portion.

The four leg pieces 12*a* to 12*d* are bent downward at locations separated from the center C by the same distance and are provided at locations closer to the center C than to the first and second opposing sides 11*a* and 11*b*.

In addition, the electric field intensity of the radiating conductor plate 8 is strong at the outer circumferential portions of the radiating conductor plate 8 on the lines S1 and S2. However, the leg pieces 12*a* to 12*d* are provided at the locations where the electric field intensity is weak with the leg pieces 12*a* to 12*d* apart from the lines S1 and S2.

Further, locking portions 13 are provided at end portions of the leg pieces 12*a* to 12*d*, respectively, and each locking portion 13 comprises a first locking piece 13*a* located at the lowest location and a second locking piece 13*b* provided apart from the first locking piece 13*a*.

In addition, the first and second locking pieces 13*a* and 13*b* are bent in the directions opposite to each other, centering each of the leg pieces 12*a* to 12*d*.

When the radiating conductor plate 8 having the above-mentioned structure is installed, first, the leg pieces 12*a* to 12*d* are bent inward against the elasticity of the leg pieces 12*a* to 12*d* in a state in which the radiating conductor plate 8 is arranged on the circuit board 2, as shown in FIG. 16.

Next, as shown in FIG. 17, convex portions of the front ends of the first and second feeding portions 9*a* and 9*b* are fitted into the second holes 3*c*, and the locking portions 13 of the leg pieces 12*a* to 12*d* are inserted into the penetrating portions 3*a*.

After that, as shown in FIG. 18, when releasing the inward bending force of the leg pieces 12*a* to 12*d*, the leg pieces 12*a* to 12*d* return to the original state by the elasticity of the leg pieces 12*a* to 12*d* themselves, the first locking pieces 13*a* are locked onto the back surface of the circuit board 2, and the second locking pieces 13*b* are locked onto the top surface of the circuit board 2. As a result, the radiating conductor plate 8 is temporally fastened on the circuit board 2, as shown in FIG. 19.

In addition, the leg pieces 12*a* to 12*d* are respectively connected to the first to fourth electrodes 5*a* to 5*d* by soldering, and the first and second feeding portions 9*a* and 9*b* are soldered to the wiring. pattern 4 provided at the periphery of the third holes 3*c*. By using the circuit board 2 and the radiating conductor plate 8, an antenna main body portion H is formed.

At that time, the leg pieces 12*a* to 12*d* and the first and second feeding portions 9*a* and 9*b* are not electrically connected to the ground conductor plate 1 by the release holes 1*g*.

In this manner, the radiating conductor plate 8 mounted on the circuit board 2 is arranged parallel to the ground conductor plate 1 and the circuit board 2 at a predetermined gap therefrom, and the first electrical length of the radiating conductor plate 8 is determined by the length of the radiating conductor plate 8 on the line S1 and the magnitude of the capacitance formed by the electrodes 5*a* and 5*b*. In addition, the second electrical length of the radiating conductor plate 8 is determined by the length of the radiating conductor plate 8 on the line S2 and the magnitude of the capacitance formed by the electrodes 5*c* and 5*d*.

According to the first embodiment, the length of the radiating conductor plate 8 on the line S1 is the same as the length of the radiating conductor plate 8 on the line S2. However, since the capacitance of the capacitor formed by the first and second electrodes 5*a* and 5*b* is smaller than that of the capacitor formed by the third and fourth electrodes 5*c* and 5*d*, the first electrical length is shorter than the second electrical length, so that the difference between the first electrical length and the second electrical length occurs, thereby obtaining a circularly polarized wave antenna device.

In addition, when the radiating conductor plate 8 is installed, the ground conductor plate 1 having an area larger than that of the radiating conductor plate 8 exists under the entire lower portion of the radiating conductor plate 8, and the circuit board 2 is located within the plane area of the radiating conductor plate 8 between the radiating conductor plate 8 and the ground conductor plate 1.

In addition, when the radiating conductor plate 8 is installed, the top surfaces of the hooking portion 1*a*, the stopper portion 1*c*, and the tall electronic component 6*a* are arranged to be opposite to the vicinity of the circumferential portion of the radiating conductor plate 8, and the front ends of the bent portions 1*f* are arranged opposite to the radiating conductor plate 8. As a result, capacitance is generated between the radiating conductor plate 8 and the hooking portion 1*a*, the stopper portion 1*c*, the tall electronic component 6*a*, and the bent portion 1*f*.

Further, the radiating conductor plate 8 is installed, the hooking portion 1*a* and the stopper portion 1*c* are arranged along the outer circumference of the radiating conductor plate 8 so that the hooking portion 1*a* and the stopper 1*c* are formed to lean toward the center C of the radiating conductor plate 8, thereby achieving a circularly polarized wave antenna device having a small size.

In addition, the lengths of the radiating conductor plate 8 on the lines S1 and S2, the capacitances of the first to fourth electrodes 5*a* to 5*d*, and the capacitances between the radiating conductor plate 8 and the hooking portion 1*a*, the stopper portion 1*c*, the tall electronic component 6*a*, and the bent portion 1*f* are set so that the frequency decreases, thereby achieving a circularly polarized wave antenna device having a small size.

A cup-shaped cover 14 made by molding an insulating material comprises an octagonal upper wall 14*a*, eight side walls 14*b* extending downward from eight sides of the upper wall 14*a*, a receiving portion 14*c* surrounded by the upper wall 14*a* and the side walls 14*b*, a concave portion 14*d* provided in the lower portion of one side wall 14*b*, clasp-shaped locking portions 14*e* respectively provided at the inner surface side of the lower portion of the side wall 14*b* every other side wall, and convex portions 14*f* protruding downward from the lower portion of each side wall 14*b* at which each locking portion 14*e* is located, as shown particularly in FIGS. 12 to 15.

In the cover 14, the entire antenna main body portion H composed of the radiating conductor portion 8 and the circuit board 2 is accommodated in the receiving portion 14*c*. In addition, in a state in which the locking portions 14*e* are put on the hooking portions 1*a*, when being pressed downward (on the side of the ground conductor plate 1), the locking portions 14*e* are snapped to the lower portions of the hooking portions 1*a* to be locked into them, so that the cover 14 is attached to the ground conductor plate 1.

At this time, the convex portions 14*f* provided at the lower portions of the side walls 14*b* are fitted into the holes 1*b* near the hooking portions 1*a*, and the cable 7 is located in the concave portion 14*d*, so that the cable 7 is pressed in the concave portion 14*d*.

A sealing sheet 15 is made of a label whose one surface is provided with an adhesive and is bonded to a back surface of the ground conductor plate 1. Therefore, the sealing sheet 15 covers the release holes 1*g*.

According to the above-mentioned configuration, the circularly polarized wave antenna device according to the first embodiment of the present invention can be formed.

Further, FIGS. 22 and 23 show a circularly polarized wave antenna device according to a second embodiment of the present invention. The circularly polarized wave antenna device according to the second embodiment will be now described with reference to FIGS. 22 and 23. A radiating conductor plate 8 according to the second embodiment has a feeding portion 9*b* composed of a bent piece which is provided on the line S2 passing the center C.

In addition, in the radiating conductor plate 8, the directions of the lines S3 and S4 passing the center C with the lines S3 and S4 displaced by 45 degrees with respect to the line S2 become the direction of electric field, and a first electrical length generated in the direction of the line S3 and a second electrical length generated in the direction of the line S4 exist.

In addition, adjusting means Z are provided along the lines S3 and S4, which are the electric field directions, and are provided at locations between the central portion and the outer circumference of the radiating conductor plate 8, except the central portion of the radiating conductor plate 8. Further, in the adjusting means Z, by cutting crosspieces 10*a* of the adjusting means Z related to ladder portions, the electrical length can be adjusted so as to extend.

In addition, the radiating conductor plate 8 comprises a pair of first opposing sides 11*a* located on the line S3 and a pair of second opposing sides 11*b* located on the line S4, and the lines S3 and S4 pass the center C and is orthogonal to each other. Further, four leg pieces 12*a*, 12*b*, 12*c*, and 12*d* provided at the locations between the central portion of the radiating conductor plate 8 and the first and second opposing sides 11*a* and 11*b* on the lines S3 and S4, except the central portion of the radiating conductor plate 8.

The four leg pieces 12*a* to 12*d* are bent downward at locations separated from the center C by the same distance and are provided at locations closer to the center C than to the first and second opposing sides 11*a* and 11*b*.

In addition, the electric field intensity of the radiating conductor plate 8 is strong at the outer circumferential portions of the radiating conductor plate 8 on the lines S3 and S4. Therefore, the leg pieces 12*a* to 12*d* are provided at the locations on the lines S3 and S4 where the electric field intensity is strong.

Further, first to fourth electrodes 5*a* to 5*d* to which the leg pieces 12*a* to 12*d* are connected have different areas, so that the difference between the first electric field and the second electric field occurs, thereby obtaining a circularly polarized wave antenna device.

The other structures of the second embodiment are the same as those of the first embodiment, the same constituent elements as those in the first embodiment have the same reference numerals. Thus, the description thereof will be omitted.

In addition, in a third embodiment of the present invention, leg pieces 12*a* to 12*d* are provided along first and second opposing sides 11*a* and 11*b* of a radiating conductor plate 8.

The other structures of the third embodiment are the same as those of the first embodiment, the same constituent elements as those in the first embodiment have the same reference numerals. Thus, the description thereof will be omitted.

What is claimed is:

1. A circularly polarized wave antenna device comprising:

a dielectric substrate provided on a ground conductor;

a plurality of electrodes provided on the dielectric substrate to face the ground conductor, the plurality of electrodes forming capacitors together with the ground conductor;

a radiating conductor plate made of a metal plate and arranged above the dielectric substrate at a predetermined gap; and a plurality of leg pieces bent toward the dielectric substrate side at a plurality of locations on the radiating conductor plate, wherein two electrical lengths on the radiating conductor plate that are generated in directions passing a center of the radiating conductor plate and being orthogonal to each other are equal to each other, the leg pieces contain two leg pieces provided on each of first and second lines that pass the center of the radiating conduct plate, the two leg pieces are orthogonal to each other at locations except a central portion of the radiating conductor plate, the leg pieces are connected to the electrodes, respectively, and areas of the electrodes to which the two leg pieces provided on the first line are connected are different from those of the electrodes to which the two leg pieces provided on the second line are connected.

2. The circularly polarized wave antenna device according to claim 1, wherein the ground conductor is formed of a ground conductor plate made of a metal plate larger than the radiating conductor plate.

3. The circularly polarized wave antenna device according to claim 1, wherein the four leg pieces are provided at locations separated from the center of the radiating conductor plate by the same distance.

4. The circularly polarized wave antenna device according to claim 1, wherein the radiating conductor plate is formed in an octagonal shape and has a pair of first opposing sides and a pair of second opposing sides respectively located on the first and second lines, and the leg pieces are provided at locations between the central portion of the radiating conductor plate and the first and second opposing sides on the first and second lines, except the central portion of the radiating conductor plate.

5. The circularly polarized wave antenna device according to claim 4, wherein the leg pieces are provided along the first and second opposing sides.

6. The circularly polarized wave antenna device according to claim 4, wherein the leg pieces are provided at locations closer to the central portion of the radiating conductor plate than to the first and second opposing sides.

* * * * *